US006024808A

United States Patent [19]

Kondo et al.

[11] Patent Number: 6,024,808

[45] Date of Patent: Feb. 15, 2000

[54] SEAMLESS STEEL PIPE MANUFACTURING METHOD AND EQUIPMENT

[75] Inventors: Kunio Kondo; Yasutaka Okada; Seiji Tanimoto, all of Osaka, Japan

[73] Assignee: Sumitomo Metal Industries, Ltd., Osaka, Japan

[21] Appl. No.: 08/973,903

[22] PCT Filed: Apr. 18, 1997

[86] PCT No.: PCT/JP97/01370

§ 371 Date: Apr. 1, 1998

§ 102(e) Date: Apr. 1, 1998

[87] PCT Pub. No.: WO97/39843

PCT Pub. Date: Oct. 30, 1997

[30] Foreign Application Priority Data

Apr. 19, 1996 [JP] Japan ..... 8-098197

[51] Int. Cl.[7] ..... C21D 8/10

[52] U.S. Cl. ..... 148/541; 148/547; 148/593; 266/102

[58] Field of Search ..... 148/541, 547, 148/593, 909; 266/102

[56] References Cited

U.S. PATENT DOCUMENTS 5,186,769 2/1993 Hunt et al. ..... 148/593

FOREIGN PATENT DOCUMENTS 0 430 909 6/1991 European Pat. Off. .
56-3626 1/1981 Japan .
56-166324 12/1981 Japan .
57-121811 7/1982 Japan .
58-91123 5/1983 Japan .
58-104120 6/1983 Japan .
58-117832 7/1983 Japan .
58-120720 7/1983 Japan .
58-224116 12/1983 Japan .
59-20423 2/1984 Japan .
60-33312 2/1985 Japan .
60-067624 4/1985 Japan .
60-75523 4/1985 Japan .
60-125326 7/1985 Japan .
61-238917 10/1986 Japan .
62-139815 6/1987 Japan .
62-151523 7/1987 Japan .
63-11621 1/1988 Japan .

(List continued on next page.)

OTHER PUBLICATIONS

H. Biller: "Das Walzen Nahtloser Rohre–Probleme der Verfahrensauswahl", Stahl u. Eisen, vol. 106, No. 9, May 5, 1986, pp. 431–437.

K. Oberem: "Herstellung nahtloser Rohre", Stahl u. Eisen, vol. 104, No. 25/26, Dec. 17, 1984, pp. 1339–1343.

The Iron and Steel Institute of Japan vol. 71, No. 8, pp. 40–47, Jun. 1985.

*Primary Examiner*—Deborah Yee

*Attorney, Agent, or Firm*—Armstrong, Westerman, Hattori, McLeland & Naughton

[57] ABSTRACT

A method of manufacturing a seamless steel pipe having excellent properties with high productivity in on-line processing, and an apparatus in which includes casting and heat treatment unit on-line. In the method the following steps (1) to (6) are successively performed. (1) A round billet is produced by continuous casting machine 1. (2) The billet is cooled to a temperature not higher than a $Ar_1$ point, then heated and soaked in a furnace 3. (3) The billet is pierced by a piercer 5 at a strain rate of not higher than 200/sec and made into a hollow shell. (4) The hollow shell is elongated and finish rolled to make into a seamless steel pipe at an average strain rate of not lower than 0.01/sec and with a reduction ratio of not lower than 40%, and finishing the rolling at a temperature from 800° C. to 1050° C. (5) The seamless steel pipe is cooled to a temperature not higher than the $Ar_3$ point at a cooling rate of not lower than 80° C./min. (6) The cooled pipe is reheated to a temperature 850–1000° C., held for 10 sec. to 30 min., then quenched and tempered.

5 Claims, 6 Drawing Sheets

| | STEEL | BILLET TEMPERATURE (°C) * | STRAIN RATE (/SEC) | | | | | | |
|---|---|---|---|---|---|---|---|---|---|
| | | | 3 | 10 | 30 | 100 | 200 | 250 | 300 |
| MAXIMUM CRACK DEPTH (mm) | A | 900 | 0 | 0 | 0 | 1.2 | 2.3 | 2.8 | 3.5 |
| | | 550 | 0 | 0 | 0 | 0 | 0 | 0.7 | 1.8 |
| | B | 900 | 0 | 0 | 0 | 1.4 | 1.9 | 2.6 | 3.1 |
| | | 420 | 0 | 0 | 0 | 0 | 0 | 0.9 | 2.3 |

NOTE: * TEMPERATURE AT THE TIME OF FURNACE CHARGE

FOREIGN PATENT DOCUMENTS

| | | | |
|---|---|---|---|
| 63-96215 | 4/1988 | Japan . | |
| 63-157705 | 6/1988 | Japan . | |
| 63-223125 | 9/1988 | Japan . | |
| 64-55335 | 3/1989 | Japan . | |
| 4-358023 | 12/1992 | Japan . | |
| 406184635 | 7/1994 | Japan | 148/593 |
| 7-041856 | 2/1995 | Japan . | |
| 8-117814 | 5/1996 | Japan . | |
| WO96/12574 | 5/1996 | WIPO . | |

Fig.2

| STEEL | CHEMICAL COMPOSITION (Fe: BAL. WEIGHT %) | | | | | | | | | | | | TRANSFORMATION POINT (°C) | |
|---|---|---|---|---|---|---|---|---|---|---|---|---|---|---|
| | C | Si | Mn | P | S | Cr | Ni | Mo | Ti | Nb | sol.A1 | N | $Ar_1$ | $Ar_3$ |
| A | 0.12 | 0.31 | 1.45 | 0.02 | 0.013 | 0.31 | 0.04 | 0.12 | 0.022 | - | 0.027 | 0.004 | 670 | 780 |
| B | 0.07 | 0.28 | 1.13 | 0.01 | 0.002 | - | - | - | 0.026 | 0.031 | 0.031 | 0.005 | 650 | 770 |

Fig.3

| | STEEL | BILLET TEMPERATURE (°C) * | STRAIN RATE (/SEC) | | | | | | |
|---|---|---|---|---|---|---|---|---|---|
| | | | 3 | 10 | 30 | 100 | 200 | 250 | 300 |
| MAXIMUM CRACK DEPTH (mm) | A | 900 | 0 | 0 | 0 | 1.2 | 2.3 | 2.8 | 3.5 |
| | | 550 | 0 | 0 | 0 | 0 | 0 | 0.7 | 1.8 |
| | B | 900 | 0 | 0 | 0 | 1.4 | 1.9 | 2.6 | 3.1 |
| | | 420 | 0 | 0 | 0 | 0 | 0 | 0.9 | 2.3 |

NOTE: * TEMPERATURE AT THE TIME OF FURNACE CHARGE

Fig.4

| | | | | | | | | | | | | | | | | | | | | | |
|---|---|---|---|---|---|---|---|---|---|---|---|---|---|---|---|---|---|---|---|---|---|
| TEMPERING TEMPERATURE (°C) | | | | | | | | | | | | | | | | | | | | | |
| OFF-LINE REHEATING AND QUENCHING TEMPERATURE (°C) | | | | | | | | | | | | | | | | | | | | | |
| REHEATING | TIME (SEC) | | | | | | | | | | | | | | | | | | | | |
| | TEMPERATURE (°C) | | | | | | | | | | | | | | | | | | | | |
| COOLING | FINISH TEMPERATURE (°C) | | | | | | | | | | | | | | | | | | | | |
| | COOLING RATE (°C/SEC) | | | | | | | | | | | | | | | | | | | | |
| WORKING BY ELONGATOR AND SIZER | FINISH TEMPERATURE (°C) | | | | | | | | | | | | | | | | | | | | |
| | AVERAGE STRAIN RATE (/SEC) | | | | | | | | | | | | | | | | | | | | |
| | REDUCTION RATIO (%) | | | | | | | | | | | | | | | | | | | | |
| WORKING BY PIERCER | STRAIN RATE (/SEC) | | | | | | | | | | | | | | | | | | | | |
| | REDUCTION RATIO (%) | | | | | | | | | | | | | | | | | | | | |
| BILLET TEMPERATURE AT THE TIME OF FURNACE CHARGE (°C) | | | | | | | | | | | | | | | | | | | | | |
| STEEL | | A | A | A | A | A | A | A | A | A | A | A | A | A | B | B | B | B | B | B | B |
| TEST NO. | | 1 | 2 | 3 | 4 | 5 | 6 | 7 | 8 | 9 | 10 | 11 | 12 | 13 | 14 | 15 | 16 | 17 | 18 | 19 | 20 |
| | | EXAMPLE OF THE INVENTION | | | | | | | | | | | | | | | | | | | |
| TEMPERING TEMPERATURE (°C) | | 650 | 650 | 650 | 650 | 650 | 650 | 650 | 650 | 650 | 650 | 650 | 650 | 650 | 600 | 600 | 600 | 600 | 600 | 600 | 600 |
| OFF-LINE REHEATING AND QUENCHING TEMPERATURE (°C) | | - | - | - | - | - | - | - | - | - | - | - | - | - | - | - | - | - | - | - | - |
| REHEATING | TIME (SEC) | 300 | 300 | 180 | 600 | 300 | 300 | 180 | 90 | 180 | 1800 | 180 | 90 | 15 | 300 | 180 | 600 | 180 | 600 | 300 | 300 |
| | TEMPERATURE (°C) | 900 | 910 | 920 | 900 | 900 | 920 | 900 | 890 | 900 | 880 | 900 | 900 | 990 | 900 | 900 | 900 | 920 | 920 | 900 | 900 |
| COOLING | FINISH TEMPERATURE (°C) | 440 | 500 | 550 | 610 | 630 | 580 | 600 | 400 | 500 | 500 | 500 | 760 | 500 | 480 | 550 | 610 | 630 | 610 | 630 | 580 |
| | COOLING RATE (°C/SEC) | 450 | 500 | 200 | 220 | 520 | 290 | 300 | 400 | 680 | 250 | 100 | 120 | 120 | 280 | 500 | 200 | 220 | 520 | 290 | 300 |
| WORKING BY ELONGATOR AND SIZER | FINISH TEMPERATURE (°C) | 850 | 880 | 870 | 820 | 850 | 860 | 850 | 940 | 850 | 810 | 980 | 850 | 870 | 820 | 870 | 820 | 850 | 820 | 850 | 860 |
| | AVERAGE STRAIN RATE (/SEC) | 0.7 | 0.65 | 0.8 | 0.5 | 0.85 | 0.6 | 0.5 | 0.75 | 0.1 | 0.05 | 0.75 | 0.55 | 0.7 | 0.65 | 0.5 | 0.8 | 0.55 | 0.8 | 0.65 | 0.5 |
| | REDUCTION RATIO (%) | 75 | 60 | 70 | 50 | 75 | 70 | 50 | 80 | 40 | 40 | 80 | 60 | 65 | 70 | 60 | 70 | 50 | 75 | 70 | 50 |
| WORKING BY PIERCER | STRAIN RATE (/SEC) | 60 | 60 | 100 | 30 | 150 | 60 | 60 | 100 | 70 | 50 | 100 | 60 | 70 | 100 | 30 | 150 | 60 | 60 | 100 | 30 |
| | REDUCTION RATIO (%) | 70 | 70 | 70 | 60 | 70 | 50 | 60 | 80 | 70 | 70 | 60 | 50 | 70 | 70 | 60 | 70 | 80 | 70 | 70 | 50 |
| BILLET TEMPERATURE AT THE TIME OF FURNACE CHARGE (°C) | | 550 | 500 | 300 | 540 | 130 | 550 | 550 | 550 | 500 | 550 | 480 | 550 | 600 | 550 | 300 | 540 | 250 | 550 | 170 | 550 |

Fig.5

| | TEST NO. | STEEL | BILLET TEMPERATURE AT THE TIME OF FURNACE CHARGE (°C) | WORKING BY PIERCER | | WORKING BY ELONGATOR AND SIZER | | | COOLING | | REHEATING | | OFF-LINE REHEATING AND QUENCHING TEMPERATURE (°C) | TEMPERING TEMPERATURE (°C) |
|---|---|---|---|---|---|---|---|---|---|---|---|---|---|---|
| | | | | REDUCTION RATIO (%) | STRAIN RATE (/SEC) | REDUCTION RATIO (%) | AVERAGE STRAIN RATE (/SEC) | FINISH TEMPERATURE (°C) | COOLING RATE (°C/SEC) | FINISH TEMPERATURE (°C) | TEMPERATURE (°C) | TIME (SEC) | | |
| COMPARATIVE EXAMPLE | 21 | A | 400 | 60 | 50 | 20* | 0.004* | 880 | 400 | 760 | 920 | 180 | - | 650 |
| | 22 | A | 550 | 60 | 100 | 75 | 0.8 | 1060* | 240 | 400 | 960 | 180 | - | 650 |
| | 23 | A | 500 | 50 | 60 | 70 | 0.65 | 850 | 30* | 760 | 910 | 180 | - | 650 |
| | 24 | A | 550 | 70 | 70 | 50 | 0.5 | 930 | 430 | 820* | 900 | 180 | - | 650 |
| | 25 | A | 450 | 70 | 60 | 80 | 0.6 | 860 | 120 | 500 | 1060* | 180 | - | 650 |
| | 26 | A | 550 | 60 | 30 | 50 | 0.3 | 850 | 360 | 500 | 980 | 3600* | - | 650 |
| | 27 | B | 550 | 60 | 90 | 10* | 0.006* | 850 | 270 | 770 | 900 | 180 | - | 600 |
| | 28 | B | 500 | 60 | 70 | 60 | 0.5 | 1100* | 120 | 590 | 930 | 180 | - | 600 |
| | 29 | B | 550 | 70 | 70 | 70 | 0.8 | 850 | 20* | 760 | 900 | 180 | - | 600 |
| | 30 | B | 450 | 60 | 70 | 60 | 0.75 | 960 | 330 | 810* | 890 | 180 | - | 600 |
| | 31 | B | 550 | 70 | 100 | 70 | 0.6 | 870 | 420 | 530 | 1050* | 180 | - | 600 |
| | 32 | B | 550 | 60 | 30 | 50 | 0.4 | 850 | 550 | 490 | 990 | 3600* | - | 600 |
| | 33 | A | ROOM | 70 | 100 | 50 | 0.5※ | 850 | - | - | - | - | 900 | 600 |
| | 34 | B | TEMPERATURE | 70 | 100 | 50 | 0.5※ | 850 | - | - | - | - | 920 | 600 |

NOTE * : OUT OF SCOPE OF THE INVENTION

※: MANDREL MILL AND SIZER ARE ARRANGED SEPARATELY.

TEST Nos. 33 AND 34 ARE EXAMPLES OF THE CONVENTIONAL METHOD

Fig.6

| | TEST NO. | STEEL | PROOF STRESS (kgf/mm2) | TENSILE STRENGTH (kgf/mm2) | GRAIN SIZE NUMBER OF PRIOR AUSTENITE GRAIN | TOUGHNESS vTrs(°C) |
|---|---|---|---|---|---|---|
| EXAMPLE OF THE INVENTION | 1 | A | 51.1 | 61.9 | 7.5 | -83 |
| | 2 | A | 55.0 | 62.9 | 6.5 | -78 |
| | 3 | A | 51.4 | 59.6 | 7.5 | -87 |
| | 4 | A | 52.3 | 60.3 | 7.5 | -84 |
| | 5 | A | 53.8 | 61.2 | 7.5 | -81 |
| | 6 | A | 54.3 | 60.2 | 7 | -78 |
| | 7 | A | 51.2 | 59.3 | 7.5 | -80 |
| | 8 | A | 54.9 | 59.1 | 6.5 | -73 |
| | 9 | A | 53.6 | 60.9 | 7 | -83 |
| | 10 | A | 51.9 | 61.9 | 7 | -81 |
| | 11 | A | 53.0 | 60.8 | 6 | -72 |
| | 12 | A | 53.5 | 61.0 | 6.5 | -78 |
| | 13 | A | 53.7 | 60.6 | 6 | -67 |
| | 14 | B | 44.0 | 50.1 | 9 | -95 |
| | 15 | B | 42.7 | 53.4 | 9 | -97 |
| | 16 | B | 40.2 | 51.7 | 8 | -86 |
| | 17 | B | 39.6 | 51.3 | 8.5 | -96 |
| | 18 | B | 41.3 | 49.8 | 7.5 | -90 |
| | 19 | B | 43.6 | 53.5 | 8 | -86 |
| | 20 | B | 40.8 | 53.8 | 9 | -101 |
| COMPARATIVE EXAMPLE | 21 | A | 53.4 | 61.6 | 5.5 | -59 |
| | 22 | A | 54.1 | 61.4 | 5 | -47 |
| | 23 | A | 51.7 | 62.6 | 5.5 | -50 |
| | 24 | A | 52.4 | 61.8 | 4.5 | -44 |
| | 25 | A | 52.2 | 61.1 | 3 | -26 |
| | 26 | A | 51.4 | 61.5 | 5 | -55 |
| | 27 | B | 42.4 | 50.5 | 6 | -60 |
| | 28 | B | 44.2 | 53.6 | 5.5 | -56 |
| | 29 | B | 44.5 | 51.8 | 6.5 | -66 |
| | 30 | B | 40.3 | 51.6 | 4.5 | -44 |
| | 31 | B | 41.6 | 49.9 | 4.5 | -41 |
| | 32 | B | 43.4 | 54.4 | 6 | -58 |
| | 33 | A | 52.7 | 56.9 | 6 | -55 |
| | 34 | B | 39.3 | 46.5 | 7.5 | -77 |

NOTE: TEST Nos. 33 AND 34 ARE EXAMPLES OF THE CONVENTIONAL METHOD.

SEAMLESS STEEL PIPE MANUFACTURING METHOD AND EQUIPMENT

TECHNICAL FIELD

The present invention relates to a seamless steel pipe manufacturing technology, more particularly, the invention relates to a method and apparatus for manufacturing a seamless steel pipe having excellent strength, toughness and corrosion resistance. The said apparatus is not only fitted for performing the said manufacturing method, but also suitable to be used broadly for manufacturing various kinds of seamless steel pipes.

BACKGROUND ART

In the steel industry, which is characterized by huge facilities and a large energy consumption, a combination of steps in the manufacturing process, socalled "on-line processing", has been developed in order to simplify the process and reduce the energy consumption. In manufacturing of the steel plate (steel strip and thick plate), a thermo-mechanical treatment in the on-line process has been adopted widely. The conventional heat treatment (such as quenching, tempering, etc.) with using apparatus, which are placed separately from the plate rolling line, is considerably decreased.

On the contrary, in the field of the seamless steel pipe manufacturing, most of the pipes are still treated in a so-called "off-line process", wherein apparatus such as a heating furnace, a cooling equipment and a tempering furnace are installed on the separate line, from the pipe manufacturing line, because the requirement for reliability and quality of the pipe product is very severe. Naturally, it is difficult to reduce the energy consumption in such manufacturing process.

A considerably large space is necessary for the off-line process carried out in the conventional factory layout, since differences of processing speed between each independent step of the process require spaces such as a billetyard to keep the billet before piercing, a space for temporal storage of the pipe before heat treatment. Furthermore, the manufacturing cost increases inevitably because of the conveyance, since the materials should be conveyed from a step to another step, transportation means such as a conveyor, a crane, a truck and operation of loading and unloading, are required.

Recently, in the field of the seamless steel pipe manufacturing, there is a tendency to introduce a so-called "direct quenching process", wherein pipes are quenched immediately after hot working with utilization of the heat retained during the hot-working. By use of this process, it is able to reduce the manufacturing cost remarkably, because a heating furnace for quenching is unnecessary.

For example, as disclosed in Publication of Japanese Patent Application (referred to as PJPA here after) Nos. 56-166324, 58-120720, 58-224116, 56020423, 60-033312, 60-075523 seamless steel pipes, including the direct quenching process in which the steel pipes are forcibly cooled immediately after finish rolling are proposed, and some of these methods have been put into practical use. Unfortunately, products obtained through the direct quenching process have a disadvantage, that the toughness and corrosion resistance of those are inferior to those of the conventional products, which are quenched and tempered in the off-line process, because the products treated by the direct quenching usually have a coarser grain size in microstructure than that of the conventional products treated by quenching and tempering in the off-line process.

In the field of the steel plate manufacturing, as mentioned above, various methods of the direct (on-line) heat treatment of the plate after hot rolling are proposed. For example, PJPA Nos. 62-139815, 63-223125 and 64-055335 disclose methods of directly quenching and tempering of steel plates, which have been worked in the non-recrystallization state and then recrystallized in order to refine grain structure. Since these methods require heavy reduction rolling at a relatively low temperature area, i.e., the non-recrystallization area, it is difficult to be applied to steel pipe rolling, which is accompanied by more complex plastic deformation than that of the plate rolling. For example, steel pipe rolling at a temperature lower than 1000° C., that is the non-recrystallization temperature, by a mandrel mill, i.e., a continuous elongating mill, can not be carried out usually because working stress exceeds the capacity of the mill. Even if the rolling could be performed, many problems, such as surface defects of the pipe and difficulty of mandrel bar extraction, which do not appear at rolling of the plate, occur.

On applying the on-line heat treatment to the manufacture process of the seamless steel pipe, a method for grain refining, by use of recrystallization after pipe forming, is disclosed in PJPA No.61-238917. However, since hot working conditions are not specified in this method, there is a possibility that unfavorable grain growth is promoted when this method is carried out in a practical mill line.

Grain refining methods by means of combination of cooling and re-heating are disclosed (refer to, for instance, PJPA Nos. 56-3626, 63-11621, 58-91123, and 58-1041209). In these methods, two or more cycles of a normal transformation from austenite to ferrite and a reverse transformation from ferrite to austenite are applied. Another grain refining method, wherein twice re-heating are performed during rolling and after rolling, is proposed in PJPA No. 58-117832. However, when the transformation occurs at the early step of finish rolling as is in the methods of PJPA No. 56-3626 and 63-11621, the grains become coarse because the heating temperature should be selected in a relatively high range in order to perform the finish rolling. If the heating temperature is not sufficiently high, the finish rolling can not be performed. In the said PJPA Nos. 58-911231, 58-104120 and 4-358023, conditions for the finish rolling are not specified. Therefore, the treatment of "normal-reverse transformation" can not applied to obtain a sufficient effect to refine grains of the steel pipe. Fine grains are surely provided by a method shown in PJPA No. 58-117832, wherein twice re-heatings are performed. However, the cost of this method is higher than that of the conventional off-line quenching and tempering process, since the cost of equipment and treatment become higher.

From the viewpoint of the continuation of manufacturing steps, there are several proposals in order to reduce cost and save space by combination of various kinds of equipment. For example, PJPA No.63-157705 discloses a method of manufacturing a seamless steel pipe, in which a billet having a round cross section (refer to as "round billet" here after) is pierced and then elongated without passing through blooming or forging step. Also, "Tetsu-to-Hagane" vol. 71(1985), No.8, pp. 965–971 discloses a manufacturing apparatus in which a mandrel mill, i.e., a continuous elongating mill, and an extracting sizer, i.e., a finish rolling mill, are directly connected.

In the method disclosed in the said PJPA No.63-157705, however, the temperature of the round billet, before being charged in the furnace and rolling conditions in the piercer, which is the skew-roll piercing mill, are not specified. In the apparatus described in the above-mentioned "Tetsu-to- Hagane", the two mills are only connected directly without any metallurgical consideration. Objects of the connection in the said apparatus are only to extract the mandrel bar from the rolled pipe, by use of the sizer, and to keep quenching temperature of the pipe. Under the present circumstances, an efficient manufacturing method for the seamless steel pipe having fine grain structure, including the online process, and apparatus suitable for the manufacturing method, in which equipment for treatment are organically arranged, do not exist and are scarcely studied.

In a typical manufacturing process of the seamless steel pipe by hot working, a round billet is pierced and rolled to a hollow shell by so-called Mannesmann piercer, which is typical one of the skew-roll piercing mills, the hollow shell is elongated into a pipe by an elongating rolling mill (referred to as "elongator" here after) such as a plug mill, a mandrel mill, etc., and then the pipe is finished, i.e., sized to the product pipe having a predetermined outer diameter by a finish rolling mill such as a sizer, a stretch reducer, etc. Steps of this conventional manufacturing process, from casting of an ingot or billet to the final product making, is roughly classified as follows.

1) A step of billet making as raw material for hollow shell,
2) A step of hot working included piercing, elongating, and finish rolling,
3) A step of quenching and tempering, i.e., a step of heat treatment.

Each step of above 1) to 3) is usually independent of others. As mentioned above, there are some proposals to combine the steps 2) and 3) continuously, and to perform the so-called on-line process. The typical one is the said direct quenching process.

However, grains of the steel, which are thermo-mechanically treated in a simple direct quench process, tend to be coarser than those of the steel which is treated in the conventional off-line heat treatment (quenching and tempering). Furthermore, it is difficult in the direct quenching process to mass-produce a seamless steel pipe having homogeneous properties steadily. The reasons is that mechanical properties such as strength of the pipe, which is manufactured in the on-line process, vary largely depending on locations in the circumference direction or in the longitudinal direction, because of fluctuation of temperature between positions of a pipe or pipes of different -manufacture lots.

The inventors have proposed, in Japanese Patent Application No. 6-255088 and PCT/JP95/02 155, a method of manufacturing a seamless steel pipe, which is characterized by specifying conditions of hot working and making grains fine by a recrystallization treatment after pipe forming. This method is epoch-making because, in spite of an on-line process for pipe manufacturing, the quality of the steel pipe manufactured by this method is comparable to or superior to that of the pipe manufactured by the conventional off-line heat treatment. Sometimes, however, the method does not fully satisfy the requirement for the seamless steel pipe having higher strength and further improved toughness.

DISCLOSURE OF THE INVENTION

The first purpose of the present invention is to provide a method of a continuous on-line process for manufacturing a seamless steel pipe having properties, which are comparable to or superior to those of the pipe manufactured by the conventional off-line heat treatment.

The second purpose of the present invention is to provide a manufacturing apparatus; in which each equipment for the above-mentioned steps 1) to 3) is arranged in one line (one equipment line) in order to make the whole apparatus compact; in which it is possible to reduce manufacturing cost by saving space and energy consumption; and in which various thermo-mechanical treatments can be performed according to requirement for properties of products.

The present invention relates to a manufacturing method as the following (1), and a manufacturing apparatus as the following (2) for the seamless steel pipe:

(1) a method of manufacturing a seamless steel pipe characterized by performing the following steps ① to ⑥ in a series on a manufacturing line;

① a step of producing a billet, having a round cross section, by continuous casting, ② a step -of cooling the billet to a temperature not higher than the $Ar_1$ transformation point, and then heating and soaking the billet at a temperature suitable for piercing of the billet, ③ a step of piercing the soaked billet into a hollow shell at a strain rate of not higher than 200/s, ④ a step of rolling the hollow shell into a seamless steel pipe at an average strain rate of not lower than 0.01/s, with a reduction ratio of not lower than 40%, and finishing the rolling at a temperature from 800° C. to 1050° C., by a mill train (a set of rolling mills), in which a continues elongating rolling mill and a finish rolling mill are closely arranged.

⑤ a step of cooling the seamless steel pipe to a temperature not higher than the $Ar_3$ transformation point at a cooling rate of not lower than 80° C./min, ⑥ a step of reheating the seamless steel pipe at a temperature in a range from 850° C. to 1000° C., for a time from 10 seconds to 30 minutes, quenching and then tempering.

The above-mentioned average strain rate in the step ④ is V ϵ expressed by the following equation (a).

$$V\epsilon=(M\epsilon+S\epsilon)/Mt \quad \text{(a)}$$

where

Mϵ: strain induced by the continuous elongating rolling mill,

Sϵ: strain induced by the finish rolling mill, and

Mt: a period of time (second), from the time when the top end of a hollow shell enters the first roll of the continuous elongating rolling mill to the time when it leaves the last roll of the finish rolling mill.

(2) An apparatus for manufacturing a seamless steel pipe, characterized in that the following (A) to (G) equipment are arranged in a series to compose a manufacturing line:

(A) a continuous casting machine for producing a billet having a round cross section, (B) a billet heating furnace for heating and soaking the billet which has been cast, (C) a skew-roll piercing mill for piercing the soaked billet to form a hollow shell, (D) a continuous elongating rolling mill for elongating the hollow shell into a pipe, (E) a finish rolling mill for the finish rolling of the pipe into a seamless steel pipe having a predetermined size, (F) a complementary heating furnace for heating, keeping or slow cooling of the seamless steel pipe after finish rolled, (G) a heat treating equipment for quenching and tempering the seamless steel pipe.

The following (3) to (5) are preferable embodiments of the apparatus according to the above (2).

(3) An apparatus according to (2), in which the distance between the continuous elongating rolling mill (D) and the finish rolling mill (E) is shorter than the length of the steel pipe which has been elongated by the continuous elongating rolling mill.

(4) An apparatus according to (2), in which a pipe cooling apparatus is installed between the finish rolling mill (E) and the complementary heating furnace (F).

(5) An apparatus according to (2), in which the distance between the continuous elongating rolling mill (D) and the finish rolling mill (E) is shorter than the length of the steel pipe which has been elongated by the continuous elongating rolling mill, and a pipe cooling apparatus is installed between the finish rolling mill (E) and the complementary heating furnace (F).

(6) An apparatus, according to (2), (3), (4) or (5), characterized in that a supplementary billet heating equipment is installed between the billet heating furnace (B) and the skew-roll piercing mill (C).

It is desirable furthermore, in these facilities, that a cooling means for the cast billet, which is capable of cooling the billet to a temperature not higher than the $Ar_3$ point, is installed between the continuous casting machine (A) and the billet heating furnace (B). These apparatus are particularly suitable for performing the manufacturing method (1) of this invention.

BRIEF DESCRIPTION OF THE DRAWINGS

FIG. 2 is a table showing chemical compositions of raw material steels used in Examples of the present invention.

FIG. 3 is a table showing relationship between strain rate and crack depth on hollow shells in a piercing test.

FIG. 4 is a table showing hot working and heat treatment conditions in Examples of the present invention.

FIG. 5 is a table showing hot working and heat treatment conditions of reference and conventional examples.

FIG. 6 is a table showing the test results of present invention, referential and conventional examples.

BEST MODE FOR CARRYING OUT THE INVENTION

Figure 1:
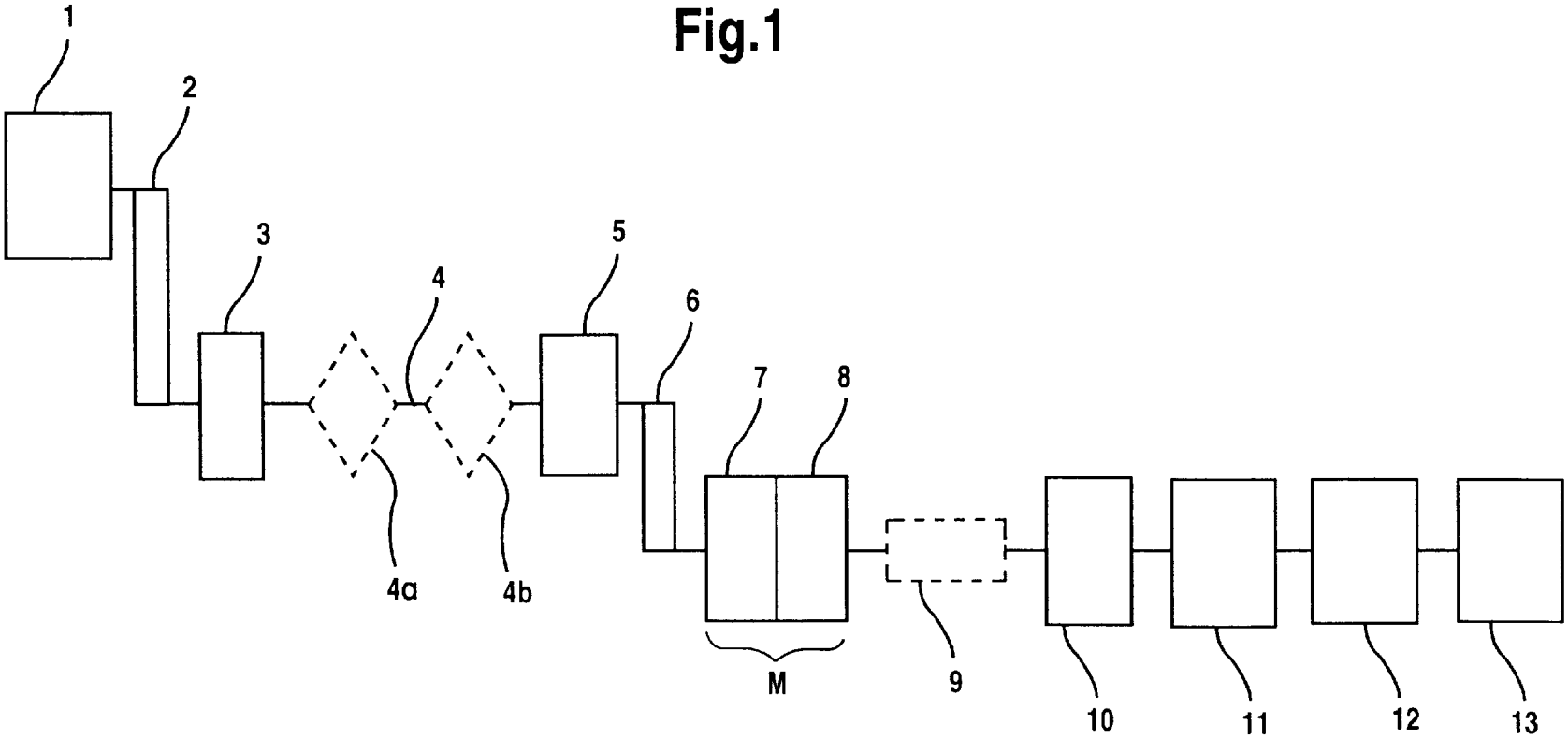
FIG. 1 is a conception diagram showing a layout of the equipment, furnace, etc., of the apparatus according to the present invention.

At first the apparatus of this invention will be explained, and then the method of this invention will be described.

I. Apparatus of This Invention for Manufacturing Seamless Steel Pipe

A conception diagram of the apparatus for manufacturing a seamless steel pipe of the present invention is shown in FIG. 1. The apparatus comprises equipment of (A) to (G) mentioned above. These are explained in order hereinafter.

(A) Continuous Casting Machine

In FIG. 1, a continuous casting machine 1 with a mold of round cross section produces a round billet continuously. Billets having various outer diameters, which are required in accordance with specified pipe manufacturing program, can be cast by selecting molds of different inner diameters. Since the cross section of the cast billet is round, any blooming or forging step is not necessary. The step is essential when the round billet is made of castings such as an ingot or a continuously cast bloom having rectangular cross section.

The continuous casting machine 1 may include one or more roll stands for applying light reduction to the cast billet in order to improve the metallographic structure of it.

The billet (round billet) is cut into predetermined length after the core of the billet has been mostly or completely solidified.

(B) Billet Heating Furnace

The billet from the casting machine 1 is heated and soaked in a billet heating furnace 3 to adjust the temperature of the billet before piercing by a skew-roll piercing rolling mill 5 (referred to as "piercer" hereafter). The billet as cast is charged into the furnace 3 through a conveyor path 2. In favor of saving energy, it is desirable that the billet from the casting machine is charged at a temperature, as high as possible, into the furnace 3. As to be described after, however, when the billet is cooled once to a temperature not higher than the $Ar_1$ transformation point, before being heated and soaked for piercing, grains of the billet become fine, and thereby surface defects of the hollow shell can be prevented, even if the billet is severely hot-worked in the next piercing step. In order to apply the cooling treatment, it is desirable that cooling means of the billet are installed on the conveyance line. The cooling means can be, for example, an extension of path of the conveyor 2, and an installation of a cooling apparatus on the conveyor 2.

In the billet heating furnace 3, the billet is heated and soaked at a suitable temperature for piercing. Energy for heating the billet is reduced by making full use of heat retained during the casting.

The preferable billet heating furnace 3 is a walking beam furnace of a type that forwards a billet in a transverse direction, or a so-called rotary furnace having a rotating furnace floor. In order to improve heating efficiency by increasing the billet-charge ratio in the heating furnace, it is preferable that length of the billet charged in the furnace is a multiple length of one billet to be pierced by the piercer. In this case, the billet is cut with a cutting equipment **4*a*, such as a gas cutter or a hot saw, which is installed on the path of conveyor 4, between the billet heating furnace 3 and a piercer 5, and the resulting billet pieces are supplied to the piercer. Furthermore, it is desirable to install an supplementary heating equipment 4*b***, such as a tunnel-type induction heater, on the downstream of the cutting equipment, in order to compensate the lost heat during conveyance or cutting operation.

(C) Skew-roll Piercing Mill (fiercer)

The round billet from the furnace 3 is pierced by a skew-roll piercing mill (piercer) 5. Since a hot-workability of the round billet as cast is poor compared with that of the billet which has been worked by blooming or forging, a hollow shell made of the as cast billet tends to induce surface defects during piercing. The tendency of inducing surface defects is able to be eliminated by grain refining before piercing and by selection of suitable strain rate for piercing as describe later. The grain refining effect can be obtained through an operation in which the billet, after casting, is cooled once to a temperature not higher than the $Ar_1$ transformation point, then reheated in the billet heating furnace.

Although the piercer may be of any type insofar as it is a skew-roll piercing mill, it is desirable to use a high toe angle skew-roll piercer, which is capable of yielding a thin-wall pipe and realizing a high pipe expansion ratio. When the high toe angle skew-roll piercer is used, the number of billets having different sizes can be decreased because many hollow shells, having various sizes, can be made of the same diameter billets by this piercer.

(D) Continuous Elongating Mill (Elongator)

A continuous elongating mill (referred to as "elongator" hereafter) 7, which has plural roll stands, rolls the pierced hollow shell into a pipe shape. The typical elongator is the mandrel mill.

Any type of the mandrel mill may be used as the elongator as long as it has a retainer for a mandrel bar (a bar retainer), which retains the rear end of the mandrel bar, and pulls back the bar through a series of caliber rolls of the mill, in order to reuse the bar after elongating rolling. Especially, it is preferable that the mandrel mill be equipped with the bar-retainer, having a function of controlling a transfer rate of the mandrel bar independently of the rolling speed of the material during rolling of the hollow shell.

The hollow shell, obtained by piercing, is conveyed through conveyer 6, such as a transverse conveyor or a longitudinal roller conveyor, to the inlet table of the elongator 7. The mandrel, rear end of which is retained by the retainer, inserted to the shell on the table and then rolling of the hollow shell starts.

(E) Finish Rolling Mil

A finish rolling mill 8, comprising plural roll stands, is called a sizer or a stretch reducer. The finish rolling mill is used in order to make the elongated pipe, from the elongator 7, into the pipe product having predetermined outer diameter.

It is desirable that the elongator 7 and the finish rolling mill 8 are arranged closely in a series on the same process line, with a distance shorter than the length of the steel pipe elongated by the elongator. In more detail, it is desirable that these two mills are arranged so that the top of the steel pipe, which has left the elongator 7, may be bitten and rolled by roll stands of the finish rolling mill 8, while the rear end of the pipe stays and is still rolled in some roll stands of the elongator. Thereby, the temperature drop of the steel pipe during working can be suppressed, and storage of deformation strain can be increased. In the pipe thus rolled, grain refining effect in the subsequent heat treatment is obtained and properties of the pipe, such as toughness, corrosion resistance, etc. are remarkably improved.

The finish rolling mill, such as a sizer or a stretch reducer, may be of any type so far as it has not any tool for regulating the inner surface of the pipe. Particularly, it is preferable to use an extracting type sizer or stretch reducer, in which the mandrel bar in the elongated pipe, can be separated and take out of the pipe.

A mill group comprising the elongator 7 and the finish rolling mill 8 described above is referred to as "mill train" M hereafter.

(F) Complementary Heating Furnace

A complementary heating furnace 10 is used for heat treatment in order to provide the steel pipe, after finish rolling, with required properties. It is one of the remarkable features of the apparatus of this invention, that the complementary furnace is installed on the same manufacturing line, including the rolling mills, etc.

In the step ⑥ of the method of this invention, as is described later, this complementary heating furnace 10 is used as a reheating furnace before quenching. The reheating not only controls the quenching temperature, but also decreases a temperature difference between the positions along longitudinal or circumference directions of a pipe, and between pipes in the same manufacturing lot. The decreased temperature difference results in the improvement of scatter of the properties between positions in one steel pipe or between pipes in the same manufacturing lot. The scatter of the properties is originated in variation of heat treatment conditions. In addition, the complementary heating furnace 10 may be used for various kinds of treatment on the rolled pipe such as a slow cooling, temperature keeping, etc. Consequently, the installation of the complementary heating furnace 10 makes it possible that many sorts of heat treatment are carried out in the on-line process, in order to satisfy the various requirement for properties of the pipes.

A cooling apparatus 9 may be installed before the complementary heating furnace 10. As an example (details will be described later), the steel pipe rolled by the finish rolling mill 8 is cooled in order-to be transformed once, by the cooling apparatus 9, at a temperature not higher than the $Ar_3$ transformation point, preferably not higher than the $Ar_1$ point, and then re-heated at a temperature not lower than the $Ar_3$, in order to be reverse-transformed, in the complementary heating furnace 10, then quenched. As a result of this processing, a steel pipe having an extreme fine grain structure is obtained, even if it is treated in the on-line process. The properties of the steel pipe are comparable to, or superior to, those of the pipe which is quenched in the conventional off-line process.

(G) Quenching and Tempering Equipment

A quenching equipment 11 is used for quenching the steel pipe after finish rolling in a condition of as rolled or of re-heated. Usually water-cooling equipment is used. In order to quench with sufficiently rapid cooling rate for a thick wall steel pipe, it is desirable that cooling means is capable of cooling both the inside and outside of the pipe at the same time. For example, an equipment, which has factions of water-jet cooling for inside and water-laminar flow cooling for outside, is preferable.

A tempering equipment 12, which may be a usual heating furnace, is placed on the down stream of the quenching equipment in the same line. It is recommendable that a straightener 13 is installed in order to straighten the steel pipe after tempering. In addition, auxiliary apparatus such as a cutter for cutting the pipe end to an even length, etc., can be installed in the same line for the pipe manufacturing, though they are not illustrated in FIG. 1.

As described above, the apparatus of the present invention makes it possible that all processes for the steel pipe manufacturing, from casting of the billet to piercing, rolling, and heat treatment, are carried out in the on-line process. Since the apparatus is compact, not only the space can be reduced, but also the conveyance of materials among the steps can be simplified and an amount of the energy consumption can be reduced.

Next, the manufacturing method of a seamless steel pipe, having superior mechanical properties and excellent corrosion resistance, by use of the abovementioned apparatus, i.e., the method of the preceding (1), is described hereinafter.

II. Manufacturing Method of the Present Invention

Each step of the manufacture method of this invention is explained hereinafter.

① Step of Making Round Billet

A billet having a round cross section is produced using the continuous casting machine 1 having molds of the round cross section with various inner diameters. The cast round billet, having a specified outer diameter and length, in accordance with hot working program for the pipe, is sent to the piercing step without passing through usual blooming or forging step.

② Step of Cooling and Reheating the Billet

The cast round billet, after being cut into a required length, if necessary, is cooled once at a temperature not higher than the $Ar_1$ transformation point, preferably in a temperature range between not higher than the $Ar_1$ but not lower than room temperature. Thereafter, the billet is charged into the subsequent billet heating furnace. Reasons for performing the said cooling are as follows.

The billet is allowed to be fed to the piercer 5 in a condition as its core portion has been solidified. Therefore, as far as the solidification is completed, the higher temperature of the billet, at the moment when it is charged in the furnace, the more the amount of energy consumption for heating the billet is reduced. In the method of the present invention, however, the billet is cooled once intentionally, in order to refine grains for improvement of its hot workability. The refined grains make it possible to perform an extreme heavy deformation of the material during piercing, for example, a thin-wall piercing and/or a high expansion ratio piercing.

It is necessary, for refining grains of the billet, to cool the billet once in a temperature range not higher than the $Ar_1$ point in order to transform it into ferrite structure from austenite structure. Since the purpose of this cooling is to induce the transformation from austenite to ferrite, it is not necessary for the cooling temperature to be too low, so far as it is not higher than the $Ar_1$ point. In order to reduce the reheating energy, it is preferably that the billet be cooled to a temperature as high as possible, so long as not higher than the $Ar_1$ point, for example a range from 400° C. to the $Ar_1$ point is recommendable.

For the purpose of the above-mentioned treatment, a consideration on the arrangement of equipment is necessary. The temperature of the cast round billet, after solidified, should become under the $Ar_1$ point (and not lower than room temperature) by the time of charging into the heating furnace. This temperature control can be realized as follows: the length of the conveyor path (conveyor path 2 shown in FIG. 1) from the continuous casting machine to the heating furnace is adequately determined to permit the billet to be cooled to a temperature not higher than the $Ar_1$ point, or a forcibly cooling apparatus such as a water spray could be installed on the conveyor path.

The billet after, cooled is, reheated and soaked sufficiently at a temperature suitable for piercing by the piercer in the next step. The heating and soaking temperature is determined in consideration of high temperature ductility and strength of the material to be pierced, because-the optimum temperature for hot working varies depending on the materials. In general, the optimum temperature is in a range of 1100–1300° C.

After reheating of the billet, if the billet temperature falls down during operations, such as cutting the billet by cutter 4a into a required length, etc., the billet may be heated again by the auxiliary heating apparatus 4b.

③ Step of Piercing

When a billet, which is as cast and has coarse grain structure is pierced, surface defects are induced usually in a hollow shell by the heavy hot working, i.e., piercing. In the method of the present invention, it is possible to obtain a crack free hollow shell because of using the billet having fine grain structure obtained in the preceding step ② and piercing under a condition of a strain rate of not higher than 200/sec. There is no critical lower limit on the strain rate so long as the strain rate is not more than 200/sec. However, the strain rate is preferably not lower than 0.1/sec. When a strain rate is below 0.1/sec, the service life of tools such as a plug, guide shoes, etc. is significantly shortened owing to the tool temperature rising as a result of long time contact with the rolled material.

As described before, it is desirable to use a high toe angle skew-roll piercer on this step. If hot workability of the material is poor, the piercing should be carried out at a temperature as high as possible. In order to maintain the material at a high temperature during piercing, it is recommendable to heat the billet by an appropriate auxiliary heating equipment 4*b*, such as the aforementioned tunnel-type induction heater installed in front of the piercer.

④ Step of Elongating and Finish Rolling

In this step, the hollow shell is continuously elongated and finish rolled into a pipe as the final product by the continuous elongating mill, i.e., the elongator (mandrel mill) comprising plural roll stands, and the finish rolling mill (sizer or stretch reducer) comprising plural roll stands also. Although the hot working is performed at a low temperature compared with the piercing in the preceding step, because of the temperature decrease, it is important that the material is sufficiently deformed in this step in order to obtain the effect of thermo-mechanical treatment for grain refining.

In the method of the present invention, the mill train M shown in FIG. 1 is used, wherein the continuous elongating mill 7 and the finish rolling mill 8 are not independently arranged far apart from each other, but are closely arranged just like an incorporated mill. More specifically, in the mill train M, the two mills 7 and 8 are arranged in series on a process line, with a distance shorter than the length of the steel pipe elongated by a continuous elongating mill 7. In this arrangement, it is possible to immediately apply an additional working to the pipe by the finish rolling mill i.e., sizer or stretch reducer, before recovering the strain induced by working in the elongator (mandrel mill), and a grain refining effect of the "normal-reverse transformation" is actualized in the subsequent heat treatment.

Even if the pipes are hot-worked with the same pass schedule of rolling, there is a difference of the grain sizes, after the normal-reverse transformation treatment, between the pipe, which has been worked by an elongator and a finish rolling mill independently arranged with a larger distance than the above mentioned distance, and the pipe worked in the mill train M. Apparently, the grains of the steel pipe, worked in the closely arranged two mills (the mill train M), become finer than those of the pipe worked in the independently arranged mills.

On the working by the mill train M, the average strain rate ($V\epsilon$) defined by the preceding Equation (a) should be not less than 0.01/sec. If the average strain rate is less than 0.0 1/sec, the grain refining effect in the subsequent steps is insufficient because storage of the strain in the material by working, is released, owing to recrystallization during intervals between rolling passes.

Working ratio of rolling in the mill train M should be not less than 40% in the reduction ratio of the cross-sectional area. If the working ratio is less than 40%, the grain refining effect, after the normal-reverse transformation, is insufficient. Effect of the finishing temperature of the pipe, in the finish rolling by the mill train M is also very important. When the temperature is in the range from 800° C. to 1050° C., the grain is significantly refined by the normal-reverse transformation in the subsequent steps.

It is unnecessary to provide particular upper limits for the average strain rate and for the working ratio, so far as it is not less than 0.01/sec and not less than 40%, respectively. However, the average strain rate is preferably not more than 10/sec because the rate over 10/sec results in short service life of tools such as the mandrel bar of the mandrel mill. Furthermore, the working ratio is preferably not higher than 95% because a working ratio more than 95% causes surface defects on the pipe.

⑤ Step of Cooling Treatment

It is one of remarkable features of the method of this invention that the heat treatment, i.e., the normal-reverse transformation, is applied to the steel pipe between the finish rolling mill (sizer) and the direct quenching equipment, after the elongating and finish rolling by the mill train M. Since grains of the steel pipe are effectively refined by a combination of the hot working by the mill train M and cooling-reheating treatment, properties of the steel pipe become comparable or superior to those of a steel pipe, which has produced by quench and temper treatment in the conventional off-line process. The cooling of this treatment is carried out using the cooling equipment 9 shown in FIG. 1.

The cooling rate of the said treatment must be not lower than 80° C./min because grains of ferrite, induced by transformation of austenite, grow to coarse grains when the cooling rate is too low. Finishing temperature of the cooling should be not higher than the $Ar_3$ point in order to refine the grain by the normal-reverse transformation. More preferably, the finishing temperature is not higher than the $Ar_1$ point in order to maximize the refining effect. Although the finishing temperature can be room temperature, it is desirable to keep the pipe at a temperature as high as possible (for example about 500° C.) for energy saving in the following reheating step.

⑥ Step of Reheating Treatment;

In this step, the steel pipe, which has once cooled and transformed into ferrite phase, after finish rolling, is reheated and kept at a temperature not lower than the $Ac_3$ point, so that the ferrite phase of the steel pipe is reverse-transformed into austenite phase. Additionally, in this step, the scatter of properties of the steel pipe, after quenching and tempering, is minimized by sufficient heating, to ensure an adequate quenching temperature and uniform soaking. The reheating is performed by the complementary heating furnace 10 shown in FIG. 1.

When the reheating temperature is lower than 850° C., or keeping time at the temperature is shorter than 10 sec, the reverse transformation is insufficient. On the other hand, when the reheating temperature is higher than 1000° C., or the keeping time is longer than 30 min, grains of the pipe grow into coarse. Therefore, it has been determined that the temperature range should be from 850° C. to 1000° C. and the retaining time should be from 10 seconds to 30 minutes.

A quenching temperature should be not lower than the $Ar_3$ transformation point in order to obtain sufficient toughness and strength. In the method of this invention the quenching is performed by rapid cooling from the said temperature, 850–1000° C. In order to quench at a sufficiently rapid cooling rate, even if the steel pipe is considerably thick, it is desirable to use the aforesaid cooling means in which both of inner and outer surfaces of the pipe can be cooled at the same time.

The steel pipe, after quenched, is then tempered by a tempering equipment, which is placed on the downstream of the quenching equipment on the same line. Since the tempering is an important step which affects properties of product pipes also, it is necessary to select an appropriate temperature according to the required properties, and to soak the pipe after quenched for sufficient period at this temperature. Deviation from the predetermined tempering temperature must be within ±10° C. at most, preferably within ±5° C. By this treatment, scatter of yield strength (YS) and tensile strength (TS) is able to be suppressed within ±5 $kgf/mm^2$ of the aimed values.

After tempering, the steel pipe is straightened, trimmed on the edge, and other accompanying usual treatments are applied, then shipped as the end product.

EXAMPLE

Example 1

Steel A and steel B, having chemical compositions shown in FIG. 2, were cast into billets by a continuous casting machine with a round mold having an inner diameter of 90 mm. After solidification, some billets of each steel were charged at 900° C., a temperature over the $Ar_3$ transformation point, into a furnace of 1250° C. and held for 1 hour; and other billets of each steel were cooled once at 550° C. or 420° C., then charged into the furnace of the same temperature as above and held for the same period. After the heating, these billets were pierced into hollow shells for piercing test with various strain rates by a piercer for experimental use. The test results are shown FIG. 3.

As is apparent from FIG. 3. surface defects were observed on the hollow shells prepared by piercing at the strain rates of 100/sec from the billets, which were charged into the 1250° C. furnace at 900° C. without being cooled lower than the $Ar_3$ point after casting. On the other hand, when billets were re-heated after being cooled under the $Ar_3$ point, good hollow shells without surface defects were made of these billets at strain rate up to 200/sec, while surface defects were observed on the hollow shells pierced at the strain rate of 250/sec or higher.

It can be concluded from the above results, that the hollow shells without surface defects are produced under severe piercing conditions, so far as the strain rate is not higher than 200/sec, provided that the billets have been once cooled in the temperature range lower than the $Ar_1$ point before billet heating.

Example 2

Steel A and steel B shown in FIG. 2 were cast into billets by a continuous casting machine with a round mold having an inner diameter of 90 mm. After solidification, these billets were cooled once in a temperature range lower than $Ar_1$ point, then were charged into a heating furnace of 1250° C. and held for 1 hour. Seamless pipes were manufactured from these billets, under the various conditions for each pipe manufacturing steps as shown in FIGS. 4 and 5. FIG. 6 shows test results of strength, prior austenite grain size (grain size before transformation) and toughness (vTrs) of the obtained pipes. The tempering temperatures were changed, depending upon the sort of steels, so that the strengths of the pipes made of the same steel may be almost the same level.

The pipe of test Nos. 33 and 34 in FIG. 5 were hot rolled by the conventional mill in which the elongator and finish rolling mill are placed separately, and heat treated in the conventional off-line process, comprising steps of reheating, quenching and tempering.

Comparing the results shown in FIG. 6 of pipes made of steel A and steel B respectively, it is apparent that all pipes of Nos. 1–20 have smaller size grains and improved toughness, in comparison with those of the pipes Nos. 33 or 34, which were manufactured by the conventional method (so-called QT treatment). The pipe Nos. 21, 22, 27 and 28 which were manufactured under unsuitable working conditions in the mandrel mill and the sizer, and the pipe Nos. 23–26 and 29–32, which were manufactured under unsuitable cooling or reheating conditions, have inferior toughness, since the grain refining effect of the normal-reverse transformation treatment is not sufficient.

Industrial Applicability

According to the manufacturing method of the present invention, not only the steps from billet casting to hot-working and heat treating can be performed in series in the on-line process, but also steel pipes having excellent qualities comparable to or superior to those of pipes manufactured in the conventional off-line process. This method can be carried out at low cost by using the apparatus of the present invention.

The apparatus of the present invention is a compact one, in which all necessary equipment is installed. Therefore, it has many advantages for utilizing factory space and simplification of manufacturing process. Further, the apparatus is applicable to the change of heat treatment conditions for various required properties of product.

We claim:

1. A method for manufacturing a seamless steel pipe comprising the steps (1) to (6) which are performed continuously in a series:

(1) producing a billet, having a round cross section, by continuous casting, (2) cooling the billet to a temperature not higher than the $Ar_1$ transformation point but higher than room temperature, and then heating and soaking the billet at a temperature suitable for piercing of the billet, (3) piercing the soaked billet into a hollow shell at a strain rate of not higher than 200/sec, (4) rolling the hollow shell into a seamless steel pipe at an average strain rate of not lower than 0.01/sec, with a reduction ratio of not lower than 40%, and immediately finishing the rolling at a temperature from 800° C. to 1050° C., by a mill train in which a continuous elongating rolling mill and a finish rolling mill are closely arranged, (5) cooling the seamless steel pipe to a temperature not higher than the $Ar_3$ transformation point at a cooling rate of not lower than 80° C./min, (6) reheating the seamless steel pipe at a temperature in a range from 850° C. to 1000° C., for a time from 10 seconds to 30 minutes, quenching, and then tempering.

2. An apparatus for manufacturing a seamless steel pipe comprising elements (A) to (G), which are arranged in a series to compose a manufacturing line:

(A) a continuous casting machine for producing a billet having a round cross section, (B) a billet heating furnace for heating and soaking the billet which has been cast, (C) a skew-roll piercing mill for piercing the soaked billet to form a hollow shell, (D) a continuous elongating rolling mill for elongating the hollow shell into a pipe, (E) a finish rolling mill for the finish rolling of the pipe into a seamless steel pipe said finish rolling mill arranged in series with said elongating rolling mill at a distance shorter than the length of pipe elongated by said elongating rolling mill, (F) a complementary heating furnace for heating, keeping or slow cooling of the seamless steel pipe after the finish rolling mill, and (G) a heat treating unit for quenching and tempering the seamless steel pipe.

3. An apparatus, according to claim 2, characterized in that a pipe cooling apparatus is installed between the finish rolling mill (E) and the complementary heating furnace (F).

4. An apparatus, according to claim 2, characterized in that the distance between the continuous elongating rolling mill (D) and the finish rolling mill (E) is shorter than the length of a raw steel pipe which has been elongated by the continuous elongating rolling mill, and a pipe cooling apparatus is installed between the finish rolling mill (E) and the complementary heating furnace (F).

5. An apparatus, according to 2, 3, or 4, characterized in that a supplementary billet heating equipment is installed between the billet heating furnace (B) and the skew-roll piercing mill (C).

* * * * *